US009889482B2

(12) United States Patent
Yu et al.

(10) Patent No.: US 9,889,482 B2
(45) Date of Patent: Feb. 13, 2018

(54) AUTOMATIC COUNTING CHAIN-CUTTING MACHINE FOR ROUND LINK CHAINS

(71) Applicant: ZHEJIANG SHUANGNIAO MACHINERY CO., LTD., Shengzhou (CN)

(72) Inventors: Xiaming Yu, Shengzhou (CN); Yiping Zhang, Shengzhou (CN); Yuchao Qiu, Shengzhou (CN)

(73) Assignee: ZHEJIANG SHUANGNIAO MACHINERY CO., LTD., Shengzhou (CN)

( * ) Notice: Subject to any disclaimer, the term of this patent is extended or adjusted under 35 U.S.C. 154(b) by 324 days.

(21) Appl. No.: 14/721,908

(22) Filed: May 26, 2015

(65) Prior Publication Data

US 2016/0207096 A1 Jul. 21, 2016

(30) Foreign Application Priority Data

Jan. 19, 2015 (CN) ..... 2015 1 0025235

(51) Int. Cl.

| | |
|---|---|
| ***B21L 21/00*** | (2006.01) |
| ***B21C 51/00*** | (2006.01) |
| ***B21L 15/00*** | (2006.01) |
| ***B21L 19/00*** | (2006.01) |

(52) U.S. Cl.

CPC ..... *B21C 51/00* (2013.01); *B21L 15/00* (2013.01); *B21L 19/00* (2013.01)

(58) Field of Classification Search

CPC ..... B21L 15/00; B21L 19/00; B21C 51/00

USPC ..... 59/11, 29

See application file for complete search history.

(56) References Cited

U.S. PATENT DOCUMENTS

| | | | | |
|---|---|---|---|---|
| 3,640,164 | A * | 2/1972 | Crafford | B21L 11/005 59/11 |
| 3,760,586 | A * | 9/1973 | Onishi | B21L 21/00 59/11 |
| 2016/0207096 | A1 * | 7/2016 | Yu | B21C 51/00 |

* cited by examiner

*Primary Examiner* — David B Jones
(74) *Attorney, Agent, or Firm* — Jiwen Chen

(57) ABSTRACT

An automatic round link chain counting and cutting machine is disclosed, comprising a machine base, a first chain box and a second chain box. The machine base is provided with a control mechanism, a drive mechanism, an anti-seizing mechanism, a chain cutting mechanism, a damping guide mechanism and a detection mechanism. The control mechanism comprises a touch panel, a PLC, a relay and a control button. The drive mechanism comprises a servo motor, a reducer and a drive sprocket. The anti-seizing mechanism comprises a first guide wheel, a first rocker arm and a first secured shaft. The chain cutting mechanism comprises a press head, a press bench and a chain cutting mold. The damping guide mechanism comprises a damping plate, a first steel plate and a second steel plate. The detection mechanism comprises a second guide wheel, a second rocker arm and a second secured shaft. The present invention has a simple structure, high practicability, realizes automatic chain counting and cutting, reduces the labor intensity of the operator, improves efficiency, is environmentally-friendly in comparison with sand wheel cutting, obtains an accurate number of cut round links, is clean and ensures hoist quality.

10 Claims, 8 Drawing Sheets

AUTOMATIC COUNTING CHAIN-CUTTING MACHINE FOR ROUND LINK CHAINS

BACKGROUND OF THE INVENTION

1. The present invention relates to an automatic round link chain counting and cutting machine.

2. Description of Related Art

During the current round link production, the entire production process from the steel wire to the round link chain is completed on automatic machines. The length of the produced round link chain reaches hundreds of meters and even longer. However, the length of the chain on the hoist is only dozens of meters, several meters or even shorter. Thus, the chain needs to be cut into the required length. In the prior art, the measurement of the chains is done by workers by two methods. One is directly counting the number of the chain links to obtain the required chain length; and the other is that a mark of the required chain length is made at the working site, and then a worker drags the chain to level with the mark on the site to obtain the required chain length. After the measurement of the required length, the part must be cut from the entire chain. According to the existing production technology, some people use a pair of wire scissors to manually cut the chains. This method is applicable to chains of small specifications only (diameter below 6 mm), while the round link chains of large specifications (diameter above 6 mm) are manually fed to a sand wheel cutter to be cut.

The existing technical solutions have some defects: 1. dust and sand generated by cutting easily adhere to the chains, and the chains with dust and sand installed on the hoist will result in a decline in the quality and service life of the hoist; 2. manual chain counting generates errors easily, so the accuracy of the required length cannot be completely ensured; 3. the operator endures a large labor intensity, so the efficiency is low; 4. cutting by the sand wheel causes environmental pollution, and the smog and powder of the steel, iron and sand wheel generated endanger the health of the operators and the people around.

BRIEF SUMMARY OF THE INVENTION

The objective of the present invention is to provide a technical solution of an automatic round link chain counting and cutting machine to overcome the defects in the prior art. Through the combined design of mechanisms and apparatuses, this machine can accurately count the link number of the round link chain and automatically cut the round link chain to obtain chains of required length, thus overcoming the defects in the prior art, reducing the labor intensity of the workers, improving efficiency and solving the problem of environmental pollution caused by sand wheel cutting.

To solve the above technical problem, the present invention employs the following technical solution:

An automatic round link chain counting and cutting machine is provided, characterized in that, the automatic round link chain counting and cutting machine comprises a machine base, a first chain box and a second chain box. The machine base is provided with a control mechanism, a drive mechanism, an anti-seizing mechanism, a chain cutting mechanism, a damping guide mechanism and a detection mechanism. The control mechanism comprises a touch panel, a PLC, a relay and a control button. The touch panel is respectively connected with the PLC, the relay and the control button through leads. The first chain box has a chain. The chain penetrates through the detection mechanism, the damping guide mechanism, the chain cutting mechanism, the anti-seizing mechanism and the drive mechanism in turn and slides to the second chain box. The chain comprises a chain link. The drive mechanism comprises a servo motor, a reducer and a drive sprocket. One end of the reducer is connected to the servo motor through a rotating shaft, and the other end of the reducer is connected with the drive sprocket through an output shaft. The drive sprocket is meshed with the chain. The anti-seizing mechanism comprises a first guide wheel, a first rocker arm and a first secured shaft. The first guide wheel is rotationally connected to one end of the first rocker arms, and the other end of the first rocker arm is rotationally connected to the first secured shaft. The first secured shaft is securely connected to the machine base. The first rocker arm is provided with a second spring. The bottom end of the second spring is securely connected to the machine base. The upper and lower sides of the first rocker arm are respectively provided with a first travel switch and a stopper. The first travel switch is connected to the PLC through the leads. The chain cutting mechanism comprises a press head, a press bench and a chain cutting mold. The chain cutting mold is located between the press head and the press bench. The damping guide mechanism comprises a damping plate, a first steel plate and a second steel plate. The first steel plate is securely connected between the damping plate and the second steel plate. The detection mechanism comprises a second guide wheel, a second rocker arm and a second secured shaft. The second guide wheel is connected to one end of the second rocker arm, and the other end of the second rocker arm is rotationally connected to the second secured shaft. The second secured shaft is securely connected to the machine base. A second travel switch is disposed below the second rocker arm. The second travel switch is connected to the PLC through the lead. The first chain box stores the original chain, and the second chain box stores the cut chains, thus facilitating the distinguishing and storage of the chain. The control mechanism can effectively transmits the specification, link number and quantity of the required chain and the walking speed of the chain to the PLC to control the whole machine to complete chain counting and cutting. This process is repeated to realize the automatic counting and cutting of chain. The accuracy of the chain counting is multiple times that of manual chain counting. Thus, the chain processing efficiency is improved and the labor intensity of the operator is reduced. The reducer on the drive mechanism can control the rotating speed of the drive sprocket so as to control the walking speed of the chain, preventing intensifying the wearing of the chain because of shaking caused by over high speed. The chain gets seized for many reasons during walking and cannot continue to walk smoothly, so the anti-seizing mechanism can stop the servo motor from rotating when the chain gets seized. After the cause of the seizure is eliminated, the whole system can run continuously. The servo motor is prevented from continuously rotating to damage the machine when the chain gets seized. When the link number reaches the set value, the press applies pressure to the chain cutting mold to cut chains. The damping guide mechanism can not only play the guide role to prevent the chain from twisting and make preparations for smoothly entering the chain cutting mold, but also play a damping role to prevent the chain from inertial movement when chain counting is complete and the drive sprocket stops rotating, and then the chain can accurately stop at the position to be cut. The detection mechanism can stop the servo motor working at the completion of counting and cutting of a chain, and start the system to work continuously after the next chain comes. Thus, the accuracy of the chain link is improved.

Furthermore, the chain cutting mold comprises a mold body and a base; the mold body is provided with an upper cutter bit and a lower cutter bit; the upper cutter bit is matched with the lower cutter bit; a straight flange of the link is located between the upper cutter bit and the lower cutter bit; the upper cutter bit is connected into a sliding chute on the mold body through a first mounting plate; the lower cutter bit is securely connected to the mold body through a second molding plate; the mold body is securely connected to the base through screws; a first spring is disposed below the upper cutter bit; and the bottom end of the first spring is securely connected to the base. The upper cutter bit and the lower cutter bit are of integral design, installed on the mold body. When the production of chains of different specifications is required, only the entire chain cutting mold is required to be placed. Refined adjustment to the position of the upper and lower cutters is not needed. Thus, the chain cutting efficiency is improved. Meanwhile, the chain cutting mold only cuts one of the straight flanges of the chain link, and moves the cut away while keeping the pitch unchanged, so the cut chains are still connected together and can be driven by the drive sprocket to accurately walk. Therefore, the counting and cutting of the chain can proceed continuously.

Furthermore, the distance between the straight-flange sections of the chain link is H. The distance H is greater than the diameter of the straight-flange section of the chain link. It is convenient to take down the chains after the counting and cutting of the chain, thus improving the working efficiency of the machine.

Furthermore, the damping plate is provided with a first cross hole. The first steel plate and the second steel plate are both provided with a second cross hole. The first cross hole is smaller than the chain, and the second cross holes are greater than the chain. The chain does not contact the first steel plate and the second steel plate when it penetrates through the damping plate.

Preferably, the damping plate is made from a flexible material. The flexible material is polyurethane or rubber. The flexible material has a low density, high abrasive resistance and flexing resistance, good vibration attenuation and skid resistance, and effectively prolongs the service life of the damping plate.

Furthermore, the centers of the first cross hole and the second cross holes are located on the same horizontal line, so the chain more stably penetrates through the damping plate, the first steel plate and the second steel plate and the chain is prevented from generating friction with the first steel plate and the second steel plate.

Furthermore, a third guide wheel is disposed between the first chain box and the detection mechanism. The third guide wheel makes sure that the chain more stably penetrates through the detection mechanism and reduces the error of the detection mechanism.

Preferably, the press is a hydraulic press or a punch press, capable of providing enough pressure for chain cutting.

Furthermore, the turn angle of the first rocker arm around the first secured shaft is a, and the scope of the turn angle a is 0°-45°, thus effectively reducing the occurrence of breakages of the chain and prolonging the service life of the machine.

Furthermore, the turn angle of the second rocker arm around the second secured shaft is b, and the scope of the turn angle b is 0°-30°, thus preventing the servo motor from rotating continuously after chain cutting and further affecting the link number of the next chain.

The present invention employing the above technical solution has the following beneficial effects:

1. The control mechanism can effectively transmits the specification, link number and quantity of the required chain and the walking speed of the chain to the PLC to control the whole machine to complete chain counting and cutting. This process is repeated to realize the automatic counting and cutting of the chain. The accuracy of the chain counting is multiple times that of manual chain counting, so the chain processing efficiency is improved and the labor intensity of the operator is reduced.

2. The chain becomes seized for many reasons during walking and cannot continue to walk smoothly, so the anti-seizing mechanism can stop the servo motor from rotating when the chain gets seized. After the cause to the seizure is eliminated, the whole system can be started to run continuously, preventing damage of the whole machine caused by continuous rotation of the servo motor when the chain gets seized. When the link number reaches the set value, the press applies pressure to the chain cutting mold to cut chains.

3. The damping guide mechanism can not only play the guide role to prevent the chain from twisting and make preparations for smoothly entering the chain cutting mold, but also play a damping role to prevent the chain from inertial movement when chain counting is complete and the drive sprocket stops rotating, and then the chain can accurately stop at the position to be cut.

4. The detection mechanism can stop the servo motor from working at the completion of the counting and cutting of a chain, and start the system to work continuously after the next chain comes. Thus, the accuracy of the chain link is improved.

5. The upper cutter bit and the lower cutter bit of the chain cutting mold are of integral design, installed on the mold body. When it is required to produce chains of different specifications, only the entire chain cutting mold is required to be placed. Refined adjustment to the position of the upper and lower cutters is not needed. Thus, the chain cutting efficiency is improved. Meanwhile, the chain cutting mold only cuts one of the straight flanges of the chain link, and moves the cut away while keeping the pitch unchanged, so the cut chains are still connected together and can be driven by the drive sprocket to accurately walk. Therefore, the counting and cutting of the chain can proceed continuously.

The present invention has a simple structure, high practicability, realizes automatic chain counting and cutting, dramatically reduces the labor intensity of the operator, improves efficiency, is basically environmentally-friendly in comparison with sand wheel cutting, obtains an accurate number of cut chain links, is clean and ensures hoist quality.

BRIEF DESCRIPTION OF THE SEVERAL VIEWS OF THE DRAWINGS

The present invention is described in further detail with reference to the attached drawings.

In the figure, 1—touch panel; 2—PLC; 3—servo motor; 4—reducer; 5—drive sprocket; 6—chain; 7—first guide wheel; 8—stopper; 9—first travel switch; 10—first rocker arm; 11—anti-seizing mechanism; 12—press head; 13—press bench; 14—chain cutting mold; 15—upper cutter bit; 16—mold body; 17—first mounting plate; 18—first spring; 19—lower cutter bit; 20—base; 21—chain link; 22—damping guide mechanism; 23—damping plate; 24—first steel plate; 25—second steel plate; 26—second guide wheel; 27—second rocker arm; 28—detection mechanism; 29—third guide wheel; 30—first chain box; 31—second chain box; 32—first secured shaft; 33—second spring; 34—machine base; 35—second mounting plate; 36—first cross hole; 37—second cross hole; 38—second travel switch; 39—second secured shaft.

DETAILED DESCRIPTION OF THE INVENTION

Embodiment 1

Figure 1:
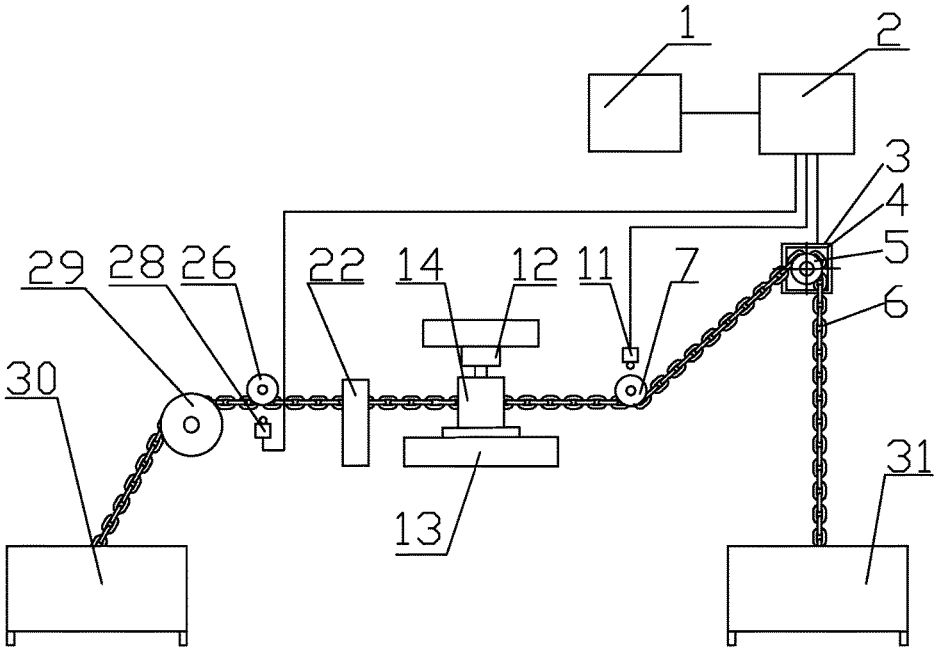
FIG. 1 is a structural view of an automatic round link chain counting and cutting machine.
Figure 2:
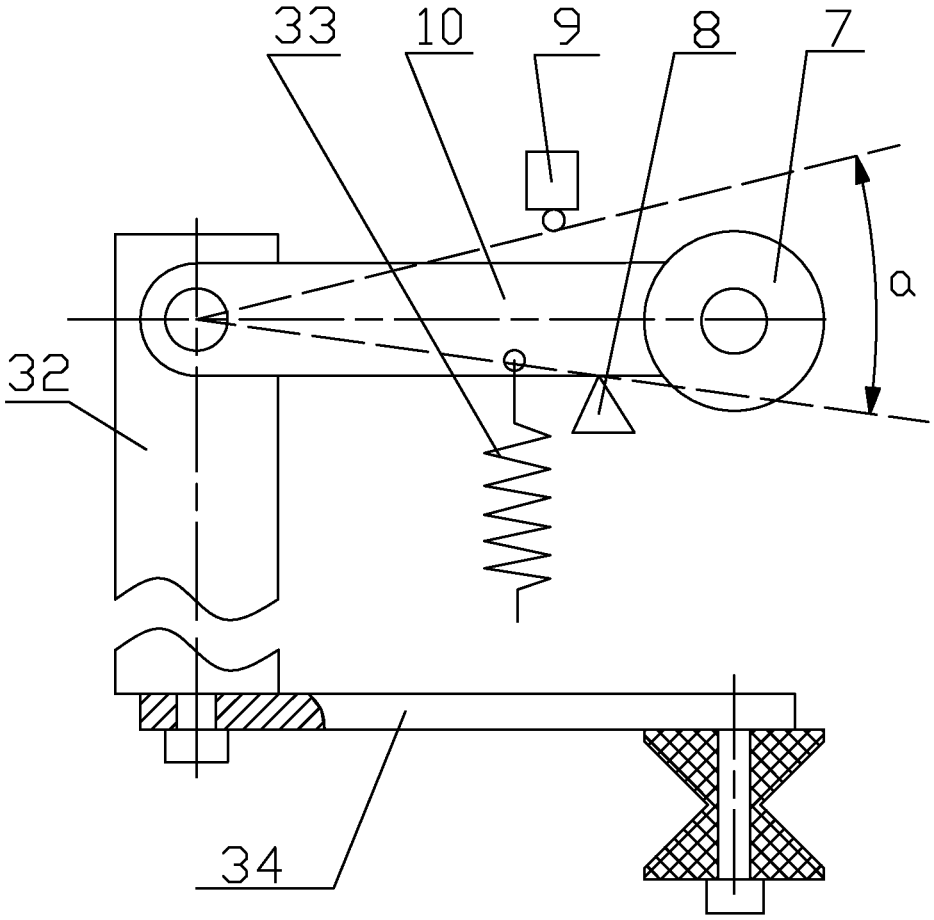
FIG. 2 is a structural view of an anti-seizing mechanism in the present invention.
Figure 3:
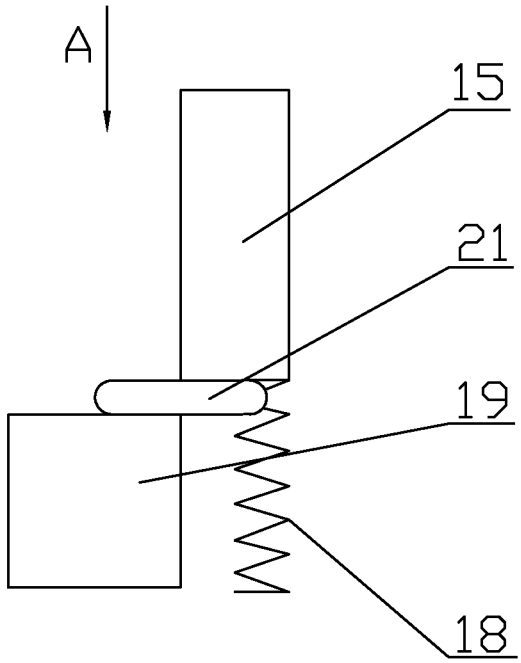
FIG. 3 is a structural view of a chain cutting mold in the present invention.
Figure 4:
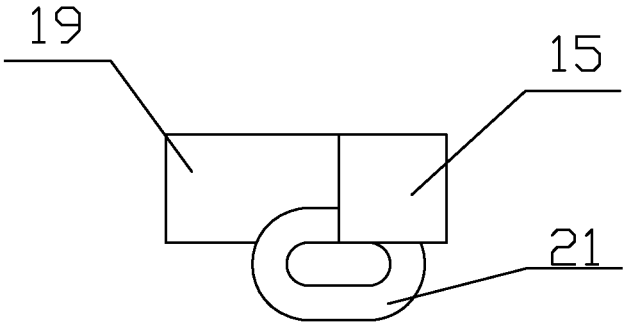
FIG. 4 is a structural view of FIG. 3 in direction A.
Figure 5:
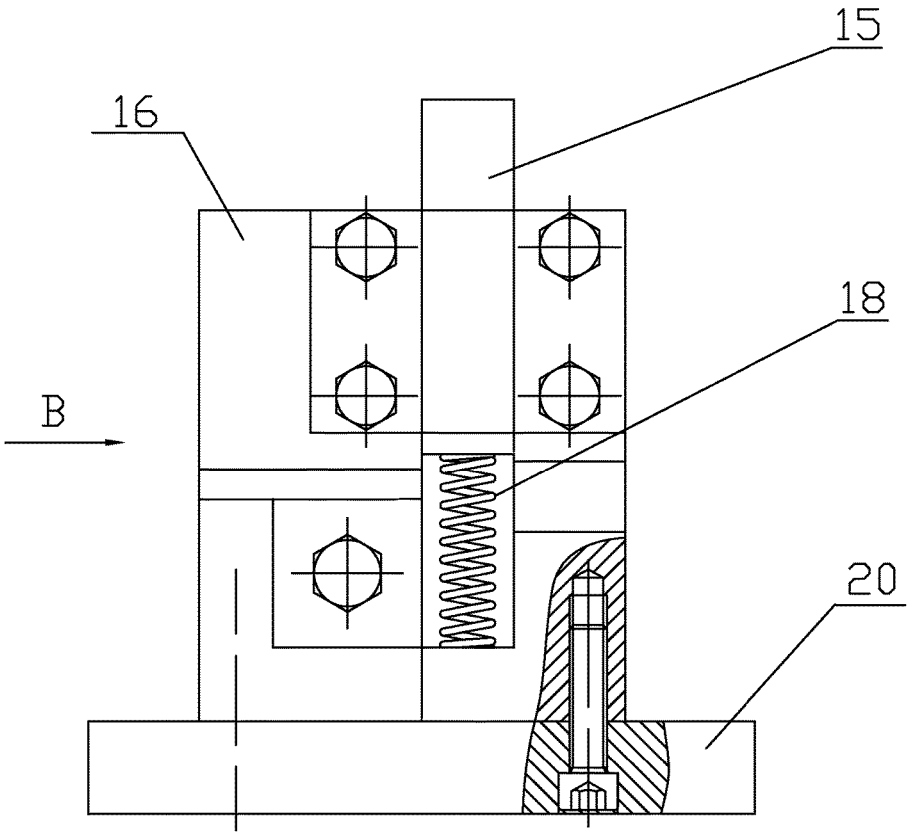
FIG. 5 is a structural view of a chain cutting mold in Embodiment 1 of the present invention.
Figure 6:
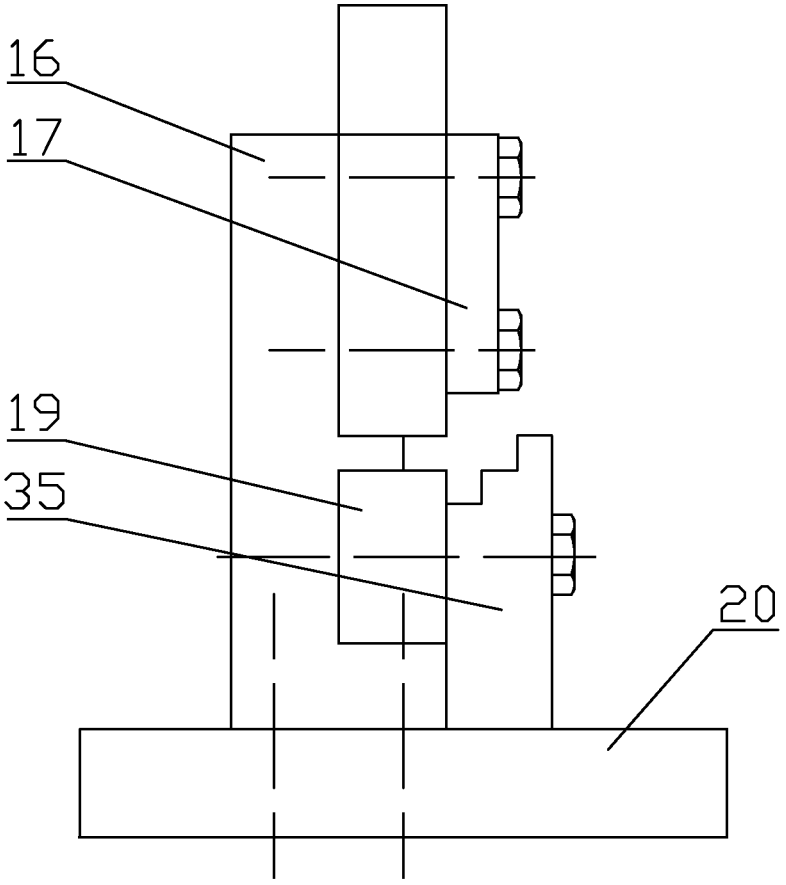
FIG. 6 is a structural view of FIG. 5 in direction B.
Figure 7:
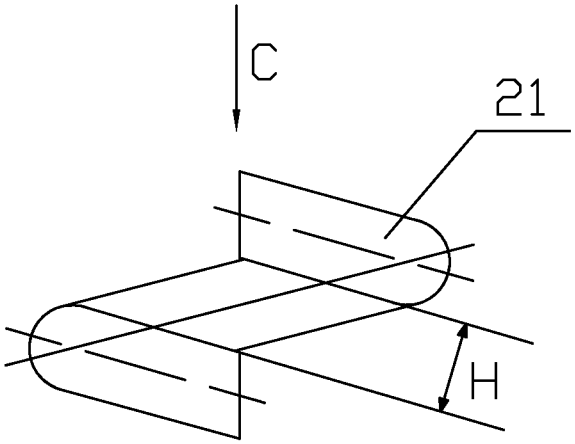
FIG. 7 is a structural view of the chain link after cutting in the present invention.
Figure 8:
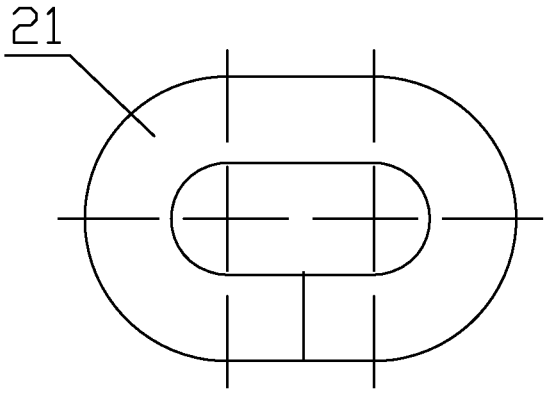
FIG. 8 is a structural view of FIG. 7 in direction C.
Figure 9:
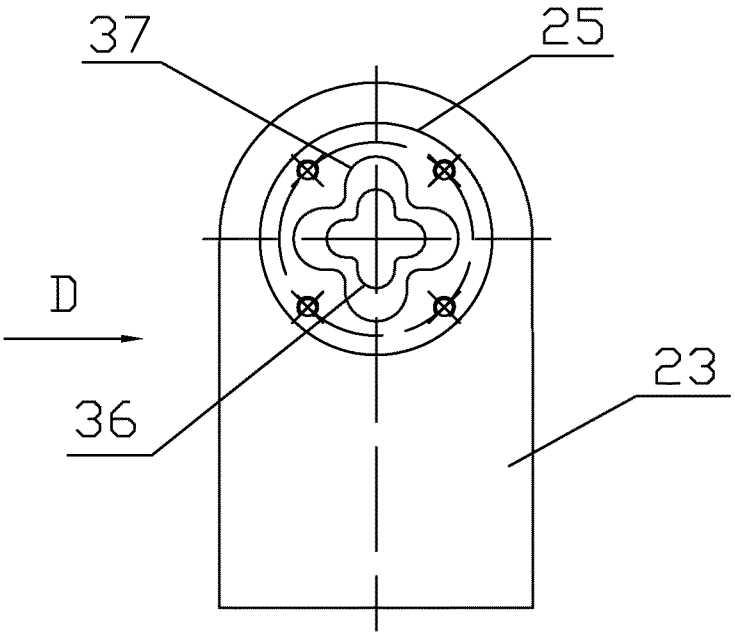
FIG. 9 is a structural view of a damping guide mechanism in the present invention.
Figure 10:
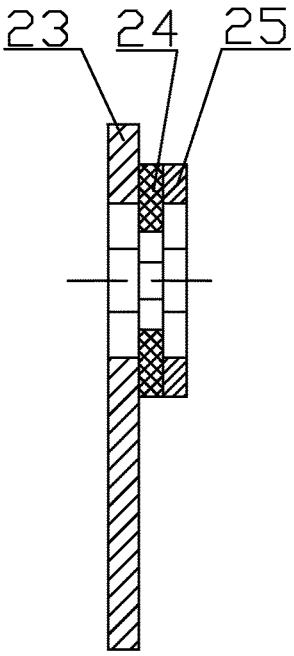
FIG. 10 is a structural view of FIG. 9 in direction D.
Figure 11:
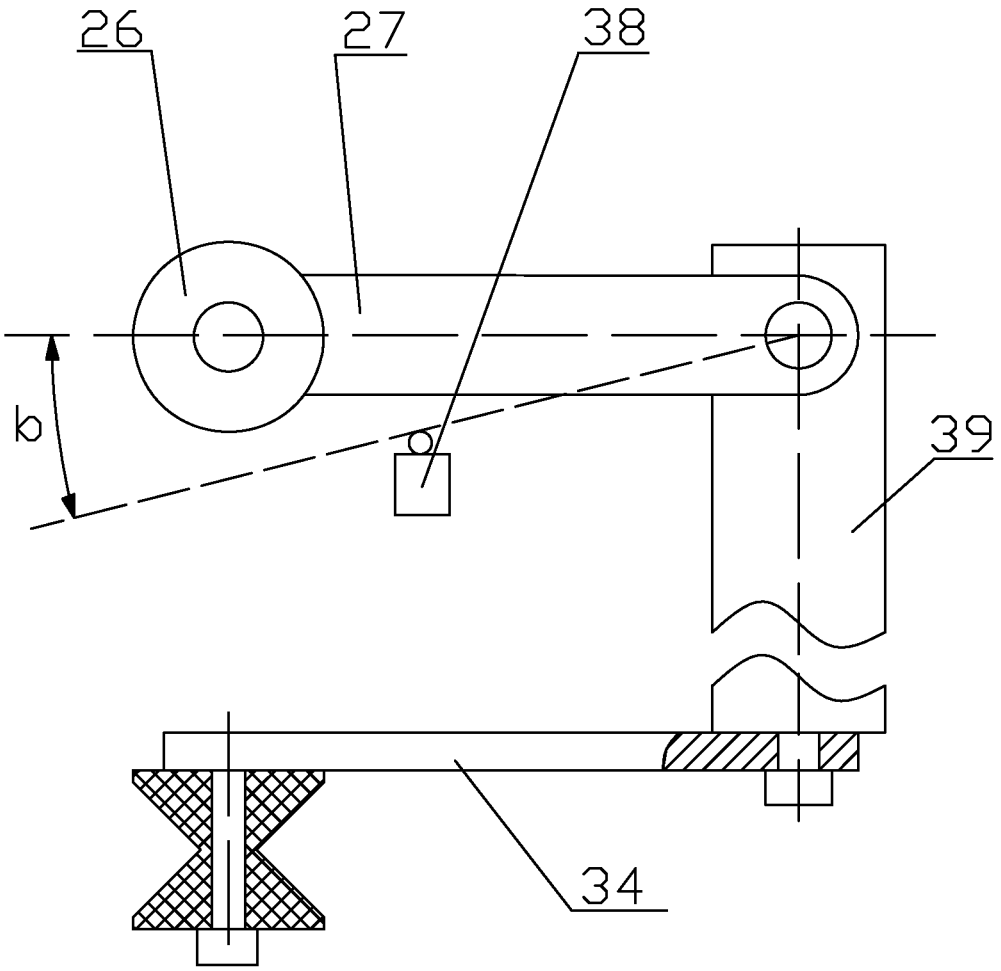
FIG. 11 is a structural view of a detecting mechanism in the present invention.

As shown in FIGS. 1-11, the present invention provides an automatic round link chain counting and cutting machine. The automatic round link chain counting and cutting machine comprises a machine base 34, a first chain box 30 and a second chain box 31. The machine base 34 is provided with a control mechanism, a drive mechanism, an anti-seizing mechanism 11, a chain cutting mechanism, a damping guide mechanism 22 and a detection mechanism 28. The control mechanism comprises a touch panel 1, a PLC 2, a relay and a control button. The touch panel 1 is respectively connected with the PLC 2, the relay and the control button through leads. The first chain box 30 has a chain 6. The chain 6 penetrates through the detection mechanism 28, the damping guide mechanism 22, the chain cutting mechanism, the anti-seizing mechanism 11 and the drive mechanism in turn and slides to the second chain box 31. The chain 6 comprises a chain link 21. A third guide wheel 29 is disposed between the first chain box 30 and the detection mechanism 28. The third guide wheel 29 makes sure that the chain 6 more stably penetrates through the detection mechanism 28 and reduces the error of the detection mechanism 28. The drive mechanism comprises a servo motor 3, a reducer 4 and a drive sprocket 5. One end of the reducer 4 is connected to the servo motor 3 through a rotating shaft, and the other end of the reducer 4 is connected with the drive sprocket 5 through an output shaft. The drive sprocket 5 is meshed with the chain 6. The anti-seizing mechanism 11 comprises a first guide wheel 7, a first rocker arm 10 and a first secured shaft 32. The first guide wheel 7 is rotationally connected to one end of the first rocker arm 10, and the other end of the first rocker arm 10 is rotationally connected to the first secured shaft 32. The turn angle of the first rocker arm 10 around the first secured shaft 32 is a, and the scope of the turn angle a is 0°-45°, thus effectively reducing the occurrence of breakages of the chain 6 and prolonging the service life of the machine. The first secured shaft 32 is securely connected to the machine base 34. The first rocker arm 10 is provided with a second spring 33. The bottom end of the second spring 33 is securely connected to the machine base 34. The upper and lower sides of the first rocker arm 10 are respectively provided with a first travel switch 9 and a stopper 8. The first travel switch 9 is connected to the PLC 2 through the leads. The chain cutting mechanism comprises a press head 12, a press bench 13 and a chain cutting mold 14. The chain cutting mold 14 is located between the press head 12 and the press bench 13. Preferably, the press is a hydraulic press or a punch press, capable of providing enough pressure for chain cutting. The chain cutting mold 14 comprises a mold body 16 and a base 20. The mold body 16 is provided with an upper cutter bit 15 and a lower cutter bit 19. The upper cutter bit 15 is matched with the lower cutter head 19. One straight flange of the chain link 21 is located between the upper cutter bit 15 and the lower cutter bit 19. The upper cutter bit 15 is connected into a sliding chute on the mold body 16 though a first mounting plate 17. The lower cutter bit 19 is securely connected to the mold body 16 through a second mounting plate 35. The mold body 16 is securely connected to the base 20 through screws. A first spring 18 is disposed below the upper cutter bit 15. The bottom end of the first spring 18 is securely connected to the base 20. The upper cutter bit 15 and the lower cutter bit 19 are of integral design, installed on the mold body 16. When it is necessary to produce chains 6 of different specifications, only the entire chain cutting mold 14 needs to be placed. Refined adjustment to the position of the upper and lower cutters is not needed. Thus, the chain cutting efficiency is improved. Meanwhile, the chain cutting mold 14 only cuts one of the straight flanges of the chain link 21, and moves the cut away while keeping the pitch unchanged, so the cut chains 6 are still connected together and can be driven by the drive sprocket 5 to walk accurately. Therefore, the counting and cutting of the chain can proceed continuously. The distance between the straight-flange sections of the chain link 21 is H. The distance H is greater than the diameter of the straight-flange section of the chain link 21. It is convenient to take down the chains after the counting and cutting of the chain, thus improving the working efficiency of the machine. The damping guide mechanism 22 comprises a damping plate 23, a first steel plate 24 and a second steel plate 25. The first steel plate 24 is securely connected between the damping plate 23 and the second steel plate 25. The damping plate 23 is provided with a first cross hole 36. The first steel plate 24 and the second steel plate 25 are both provided with a second cross hole 37. The first cross hole 36 is smaller than the chain 6, and the second cross holes 37 are greater than the chain 6, the chain 6 does not contact the first steel plate 24 and the second steel plate 25 when it penetrates through the damping plate 23. The centers of the first cross hole 36 and the second cross holes 37 are located on the same horizontal line, so the chain 6 more stably penetrates through the damping plate 23, the first steel plate 24 and the second steel plate 25 and the chain 6 is prevented from generating friction with the first steel plate 24 and the second steel plate 25 Preferably, the material of the damping plate 23 is made from a flexible material. The flexible material is polyurethane or rubber. The flexible material has a low density, high abrasive resistance and flexing resistance, and good vibration attenuation and skid resistance, and effectively prolongs the service life of the damping plate 23. The detection mechanism 28 comprises a second guide wheel 26, a second rocker arm 27 and a second secured shaft 39. The second guide wheel 26 is rotationally connected to one of the second rocker arm 27, and the other end of the second rocker arm 27 is rotationally connected to the second secured shaft 39. The turn angle b of the second rocker arm 27 is around the second secured shaft 39, and the scope of the turn angle b is 0°-30°, thus preventing the servo motor 3 from rotating continuously after chain cutting and further affecting the link number of the next chain. The second secured shaft 39 is securely connected to the machine base 34. A second travel switch 38 is disposed below the second rocker arm 27. The second travel switch 38 is connected to the PLC 2 through the lead. The first chain box 30 stores the original chain 6, and the second chain box 31 stores the cut chains 6, thus facilitating the distinguishing and storage of the chain 6. The control mechanism can effectively transmit the specification, link number and quantity of the required chain and the walking speed of the chain 6 to the PLC 2 to control the whole machine to complete chain counting and cutting. This process is repeated to realize the automatic counting and cutting of the chain. The accuracy of the chain counting is multiple times that of the manual chain counting. So, the chain 6 processing efficiency is improved and the labor intensity of the operator is reduced. The reducer 4 on the drive mechanism can control the rotating speed of the drive sprocket 5 so as to control the walking speed of the chain 6, preventing intensifying the wearing of the chain 6 because of shaking caused by overly high speed. The chain 6 gets seized for many reasons during walking and cannot continue to walk smoothly. The anti-seizing mechanism 11 can stop the servo motor 3 from rotating when the chain 6 gets seized. After the cause of the seizure is eliminated, the whole system can run continuously. The servo motor 3 is prevented from continuously rotating to break the chain 6 when the chain 6 gets seized, thus reducing the reject ratio of the chain 6. When the link number reaches the set value, the press applies pressure to the chain cutting mold 14 to cut chains. The damping guide mechanism 22 can not only play the guide role to prevent the chain 6 from twisting and make preparations for smoothly entering the chain cutting mold 14, but also play a damping role to prevent the chain 6 from inertial movement when chain counting is complete and the drive sprocket 5 stops rotating, and then the chain 6 can accurately stop at the position to be cut. The detection mechanism 28 can stop the servo motor 3 from working at the completion of counting and the cutting of a chain, and starts the system to work continuously after the next chain comes. Thus, the accuracy of the chain link 21 is improved.

The working principle of the present invention is as follows:

Power on the machine first, penetrate the chain 6 from the first chain box 30 to the detection mechanism 28, the damping guide mechanism 22, the chain cutting mechanism, an anti-seizing mechanism 11 and the drive mechanism in turn to the second chain box 31. Then, input the required chain link number, quantity, and the walking speed of the chain to the machine through the touch panel 1.

Start the servo motor 3 and then the drive sprocket 5 rotates and brings the chain 6 to walk. When the detection mechanism 28 detects that the chain link number is equal to the set value, the second rocker arm 27 rotates by the effect of the gravity, while the second travel switch 38 below acts and transmits an electric signal to the PLC 2 to control the servo motor 3 to stop rotating. The damping mechanism 22 prevents the chain 6 from twisting and the chain 6 from inertial movement such that the chain 6 stops at a position to be cut. When the press applies pressure, the press head of the chain cutting mold 14 presses down and contacts the upper cutter bit 15 (the upper cutter bit 15 is installed in the sliding chute of the mold body 16 and can slide up and down, and in the free state, the upper cutter bit stops at the above position by the spring force of the first spring 18 below), and the upper cutter bit 15 is driven to move downward and together with the lower cutter bit 19 secured on the mold plate to generate shearing action so as to cut off the chain link 21 there-between. The upper cutter bit 15 continuously moves downward to separate the two sides of the cut position of the chain link 21 by a certain distance (capable of being separated from the adjacent chain links). Then, take down the chain 6. The operator feeds the next chain and starts the system to work continuously. Repeat this process to realize the automatic counting and cutting of the chain.

In a normal situation, the first rocker arm 10 is pulled down by the second spring 33 to lean against the stopper 8. When the chain 6 gets seized, the first guide wheel 7 is pulled upward, driving the first rocker arm 10 to rotate upward and contact the first travel switch 9. The first travel switch 9 acts and transmits an electric signal to the PLC 2. The PLC 2 controls the servo motor 3 to stop rotating. When the cause of seizure is eliminated, the entire system can be started to work continuously.

The above is only a specific embodiment of the present invention, but the technical characteristics of the present invention is not limited to the above embodiment. Any simple changes, equivalent substitution or modifications on the basis of the present invention to realize basically the same technical effects shall be incorporated into the protective scope of the present invention.

The invention claimed is:

1. An automatic round link chain counting and cutting machine, characterized in that, the automatic counting chain cutter comprises a machine base, a first chain box and a second chain box respectively installed on the machine and spaced apart; the machine base is provided thereon with a control mechanism, a drive mechanism, an anti-seizing mechanism, a chain cutting mechanism, a damping guide mechanism and a detection mechanism respectively and spaced apart; the control mechanism comprises a touch panel, a programmable logic controller (PLC), a relay and a control button; the touch panel is respectively connected with the PLC, the relay and the control button through conductive wires; the first chain box has chains inside; the chains serially penetrate through the detection mechanism, the damping guide mechanism, the chain cutting mechanism, the anti-seizing mechanism and the drive mechanism in turn and slides to the second chain box; the chains include links; the drive mechanism comprises a servo, a reducer and a drive sprocket; one end of the reducer is connected with the servo motor through a rotating shaft of the reducer; another end of the reducer is connected with the drive sprocket through an output shaft of the reducer; the drive sprocket is meshed with the chain; the anti-seizing mechanism comprises a first guide wheel, a first rocker arm and a first secured shaft; the first guide wheel is rotationally connected to one end of the first rocker arm; the other end of the first rocker arm is rotationally connected to the first secured shaft; the first secured shaft is securely connected to the machine base; the first rocker arm is provided with a second spring; a bottom end of the second spring is securely connected to the machine base; the upper and lower sides of the first rocker arm are respectively provided with a first travel switch and a stopper; the first travel switch is conductively connected to the PLC; the chain cutting mechanism comprises a press head, a press bench and a chain cutting mold; the chain cutting mold is located between the press head and the press bench; the damping guide mechanism comprises a damping plate, a first steel plate and a second steel plate; the first steel plate is securely connected between the damping plate and the second steel plate; the detection mechanism comprises a second guide wheel, a second rocker arm and a second secured shaft; the second guide wheel is rotationally connected to one end of the second rocker arm; the other end of the second rocker arm is connected to the second secured shaft; the second secured shaft is securely connected to the machine base; a second travel switch is disposed below the second rocker arm; and the second travel switch is conductively connected to the PLC.

2. The automatic round link chain counting and cutting machine according to claim 1, characterized in that, the chain cutting mold comprises a mold body and a base; the mold body is provided with an upper cutter bit and a lower cutter bit; the upper cutter bit is matched with the lower cutter bit; a straight flange of the link is located between the upper cutter bit and the lower cutter bit; the upper cutter bit is connected into a sliding chute on the mold body through a first mounting plate; the lower cutter bit is securely connected to the mold body through a second molding plate; the mold body is securely connected to the base through screws; a first spring is disposed below the upper cutter bit; and the bottom end of the first spring is securely connected to the base.

3. The automatic round link chain counting and cutting machine according to claim 2, characterized in that, the distance between the straight-flange sections of the link is H, and the distance H is greater than the diameter of the straight-flange section of the link.

4. The automatic round link chain counting and cutting machine according to claim 1, characterized in that, the damping plate is provided with a first cross hole; the first steel plate and the second steel plate are both provided with a second cross hole; the first cross hole is smaller than the chain; and the second cross holes are larger than the chain.

5. The automatic round link chain counting and cutting machine according to claim 4, characterized in that, the damping plate is made from a flexible material, and the flexible material is polyurethane or rubber.

6. The automatic round link chain counting and cutting machine according to claim 4, characterized in that, the centers of the first cross hole and the second cross holes are on the same horizontal line.

7. The automatic round link chain counting and cutting machine according to claim 1, characterized in that, a third guide wheel is disposed between the first chain box and the detection mechanism.

8. The automatic round link chain counting and cutting machine according to claim 1, characterized in that, the press is a hydraulic press or a punch press.

9. The automatic round link chain counting and cutting machine according to claim 1, characterized in that, the turn angle of the first rocker arm around the first secured shaft is a, and the scope of the turn angle a is 0°-45°.

10. The automatic round link chain counting and cutting machine according to claim 1, characterized in that, the turn angle of the second rocker arm around the second secured shaft is b, and the scope of the turn angle b is 0°-30°.

* * * * *